US007217302B1

(12) United States Patent
Nilsson

(10) Patent No.: US 7,217,302 B1
(45) Date of Patent: May 15, 2007

(54) PROCESS FOR COOLING SOLID AND GASEOUS MATERIAL DURING GASIFICATION OF SPENT LIQUOR

(75) Inventor: Bengt Nilsson, Skoghall (SE)

(73) Assignee: Chemrec Aktiebolag, Stockholm (SE)

( * ) Notice: Subject to any disclaimer, the term of this patent is extended or adjusted under 35 U.S.C. 154(b) by 0 days.

(21) Appl. No.: 09/937,659

(22) PCT Filed: Mar. 22, 2000

(86) PCT No.: PCT/SE00/00547

§ 371 (c)(1),
(2), (4) Date: Nov. 6, 2001

(87) PCT Pub. No.: WO00/60161

PCT Pub. Date: Oct. 12, 2000

(30) Foreign Application Priority Data

Apr. 1, 1999 (SE) ..... 9901185

(51) Int. Cl.
*C10J 3/46* (2006.01)
*F28D 21/00* (2006.01)

(52) U.S. Cl. ..... 48/197 R; 48/209; 48/203; 422/207

(58) Field of Classification Search ..... 48/197 R, 48/203, 209; 261/108, 110; 162/30.1, 30.11, 162/31

See application file for complete search history.

(56) References Cited

U.S. PATENT DOCUMENTS 4,773,918 A * 9/1988 Kohl ..... 48/197 R
4,808,264 A * 2/1989 Kignell ..... 162/30.1
6,062,547 A * 5/2000 Nilsson ..... 261/108

FOREIGN PATENT DOCUMENTS

| | | | |
|---|---|---|---|
| SE | 448173 B | | 1/1987 |
| WO | WO 9535410 A1 | | 12/1995 |
| WO | WO 961468 A1 | | 5/1996 |
| WO | WO 2001/27384 A1 | * | 4/2001 |

* cited by examiner

*Primary Examiner*—Glenn Caldarola
*Assistant Examiner*—Tom P. Duong
(74) *Attorney, Agent, or Firm*—Jeffrey S. Melcher; Manelli Denison & Selter, PLLC

(57) ABSTRACT

Process for the recovery of chemicals and energy from spent liquor obtained in the chemical pulping process, in which the spent liquor is gasified under sub-stoichiometric conditions to produce partly one phase of solid and/or fused material, together with partly one phase of a flammable gaseous material, whereafter the said phases are cooled by direct contact with a cooling medium (9), is separated from the said phase of flammable gaseous material in order to be dissolved and collected up as a product liquid in a product liquid receiver (11). According to the invention, the said cooling medium (9) consists of an essentially water-free cooling medium, which after vaporizing/cracking increases the calorific value of the flammable gaseous material drawn off. At the same time, the process is improved in this way since the flammable gases can be used more effectively for the purpose of e.g. generating energy.

14 Claims, 1 Drawing Sheet

PROCESS FOR COOLING SOLID AND GASEOUS MATERIAL DURING GASIFICATION OF SPENT LIQUOR

TECHNICAL FIELD

The present invention concerns a process for the recovery of chemicals and energy from the spent liquor obtained in the chemical pulping process, in which the spent liquor is gasified under sub-stoichiometric conditions to produce partly one phase of solid and/or fused material and partly one phase of a flammable gaseous material, whereafter the said phases are cooled by direct contact with a cooling medium, and the solid and/or fused material is/are separated from the said flammable gaseous phase to be dissolved and collected as a product liquid in a product liquid receiver.

STATE OF THE ART

For a very long time the commercially dominating process conventionally used for the recovery of energy and chemicals from the so-called black liquor, which is obtained in the production of paper pulp according to the sulphate method, has been the so-called Tomlinson process which uses a so-called soda furnace.

A more modern process is described in Swedish patent SE-C-448 173, which process is based on the sub-stoichiometric gasification/pyrolysis (i.e. a deficiency of oxygen) of the black liquor in a reactor. The resulting products are one phase consisting of solid and/or fused material, chiefly containing sodium carbonate, sodium hydroxide and sodium sulphide plus a high calorific value flammable gaseous phase, chiefly containing carbon monoxide, carbon dioxide, methane, hydrogen gas and hydrogen sulphide. The mixture of the solid/fused phase and the gaseous phase is cooled and separated by direct contact with green liquor in a separating unit connected to the reactor, the solid/fused phase being dissolved in the green liquor. The green liquor is then led to a conventional causticizing step for the production of white liquor. The gaseous phase is used as fuel for the generation of steam and/or electrical power.

WO95/35410 and WO96/14468 disclose examples of further development of the process described in SE-C-448 173. In these two patent applications the problem, among others, concerning the ability to minimize the content of bicarbonate and carbonate in the liquor produced is dealt with, the resolutions include the minimization of contact between the gaseous phase and the liquor formed in the gasification, as well as the recycling of hydrogen sulphide back to the reactor thereby shifting the reaction equilibrium therein.

It is now evident that further measures can be needed in certain cases to avoid a bicarbonate content and to minimize the carbonate content of the green liquor produced as a consequence of the absorption of carbon dioxide from the flue gas into the liquor produced. In WO95/35410 it is disclosed for example that a small part of the green liquor is used to wet the inside of the separating section between the reactor and the product liquid receiver. This small quantity of green liquor has been shown to lead to undesirable absorption of carbon dioxide in the green liquor, with resulting production of bicarbonate and increased carbonate content.

It is also evident that the water which is sprayed in dissolves the condensed drops of fused material to form a water-fused material solution, in which the hot solution is soon carbonated by carbon dioxide contained in the flue gas.

This suggests that water ought to be avoided in the hot transfer zones where the carbon dioxide content of the flue gas can lead to carbonate formation.

SUMMARY OF THE INVENTION

The present invention has the objective of minimizing or eliminating the problems mentioned above, in which a process for the sub-stoichiometric gasification of spent liquor, which leads to reduced carbonate formation and eliminates the bicarbonate content of the produced liquor and simultaneously increases the calorific value of the flue gas, is disclosed.

The process according to the invention is defined in Patent claim 1.

Thus, according to the invention, a cooling medium is provided, which is used in the reactor's outflow of product gases and product fused or solid material, which is an essentially water-free cooling medium, which cooling medium is at least partly vaporized or cracked.

The vaporized/cracked cooling medium is thereafter drawn off together with the phase of flammable gaseous material, and which cooling medium is chosen so that preferably after vaporization/cracking it increases the calorific value of the flammable gaseous material.

According to one aspect of the invention, the cooling medium provided is a liquified gas, which preferably is chosen from the group which consists of nitrogen, methane, propane or other hydrocarbons which are in the gaseous state at NTP. NTP is defined as 0° C. and 1.013 bar. In order for the gas to be liquified for use in connection with the process according to the invention, it has been cooled and/or compressed.

According to another aspect of the invention, the cooling medium consists of at least one essentially organic liquid, which is chosen preferably from the group which consists of turpentine, tall oil, methanol and other alcohols which are in the liquid state at NTP.

According to a further aspect of the invention, the cooling medium is recovered in association with the process for the said chemical pulping process or with the process for the recovery of chemicals and energy from the spent liquor. Thus, the cooling medium is preferably produced internally in the factory starting with the traditional raw materials and products in a pulp factory. Turpentine, tall oil and methanol are all by-products of pulping process.

An inert gas can be added immediately above the product liquid receiver surface to form a protecting blanket over the product liquid receiver to prevent carbonation of boiling and splashing green liquor from the product liquid receiver.

When using the process according to the invention, getting fused material drops going into solution is avoided. Thus, carbon dioxide absorption is prevented/minimized and at the same time the vaporized/cracked cooling medium increases the calorific value of the flue gas.

The cooling media should be chosen according to their capacity to reduce the temperature in the separating section, preferably down to a level where some overheating remains. The remaining cooling down to saturation temperature for the flue gases takes place in the condensate bath and for the fused material fraction in the product liquid receiver.

The ceramic lined upper part of the reactor is connected to a liquid film cooled separating section for fused material/flue gas. Also in this separating section, a large proportion of the reactions takes place, so that the reaction space consists partly of the upper part of the reactor plus the subsequent separating section.

DETAILED DESCRIPTION OF THE INVENTION

Figure 1:
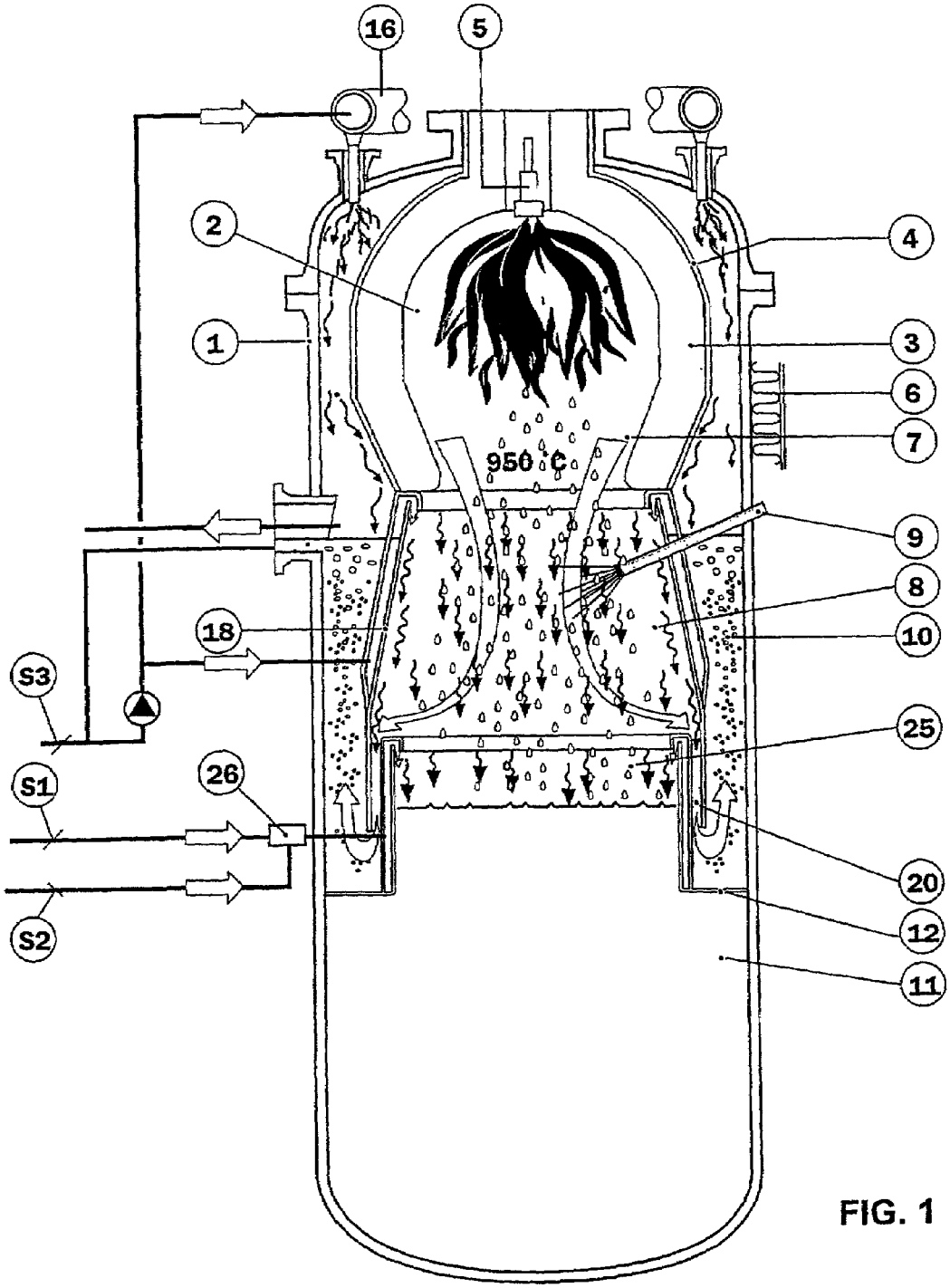
FIG. 1 illustrates a pressure vessel according to the present invention.

The invention is described by means of an embodiment in the following and by reference to FIG. 1.

A pressure vessel 1 is shown in FIG. 1. On the exterior of the pressure vessel 1 there is an insulation 6 and within the pressure vessel 1 an upper reactor section 2 is arranged which is made of a shell 4 of sheet metal fitted with a ceramic lining 3.

A burner 5 for black liquor is arranged at the top of the reactor part 2 in association with inlets, not shown, for black liquor and oxygen and/or other oxygen containing gas such as air. At the bottom of the reactor section there is an opening 7 by which opening a separating section 8 is connected to the reactor section. Arranged around the separating section 8 there is a cooling liquid bath 10, henceforth called the condensate bath. In the embodiment shown the condensate bath 10 is located in the same vessel 1 as is the reactor section 2, the separating section 8 and a product liquid receiver 11, henceforth called the green liquor receiver. The green liquor receiver 11 is here located beneath the condensate bath 10, from which it is separated by a horizontal divider 12.

In the embodiment, the essentially water-free cooling medium is sprayed 9, via spray lances or spray nozzles, into a separating section 8 in order to cool the stream of solid and/or fused phase and flue gases flowing out of the reactor. Only one spray lance 9 is shown in FIG. 1 but it should be understood that a number of such lances can be arranged round the circumference of the separating section 8. Vaporized/cracked cooling medium leaves the separating section with the flue gas through an exit 20 to be led thereafter to burners and/or gas-driven turbines for electricity generation in the so-called combined heat and power concept.

In the embodiment, the upper part of the separating section 8 is cooled/wetted with condensate from the condensate bath 10, which is used to form a liquid film on the inside of a wall 18 of the separating section 8. The inside of the lower part 25 is cooled/wetted in a corresponding way with a film of green liquor from the green liquor receiver 11.

Other embodiments can be envisaged without the spray lances or nozzles, but with a supply of the essentially water-free cooling medium as a cooling/wetting liquid film in the upper and/or lower parts of the separating section. Yet another variant is, with or without supplementary spray lances or nozzles with essentially water-free cooling medium, to have essentially the water-free cooling medium as cooling/wetting liquid in the upper part of the separating section, while the cooling/wetting liquid in the lower part of the separation section consists of the green liquor. Naturally, the essentially water-free cooling medium can be used as the cooling/wetting liquid in both the upper part of the separating section and in the lower part as well as in the spray lances. In the case of embodiments with the separation section in only one part, it is possible to envisage, in a corresponding way, introducing the essentially water free liquid via spray lances/nozzles and/or as cooling/wetting liquid on the inside of the separation section, or that the inside of the separation section is cooled/wetted with a water-containing liquid, e.g. condensate. Those skilled in the art can easily see how the various liquids can be distributed and used according to the various permutations of the apparatus.

The invention is not limited to the embodiments presented above, but includes variations within the scope of the following patent claims. The arrangement can e.g. also be used in connection with the sub-stoichiometric gasification of spent liquors other than conventional black liquor e.g. sulphite liquor, bleaching liquor or black liquor from a potassium-based process. Furthermore, the green liquor receiver can be replaced with a white liquor receiver, when the process is arranged to avoid causticizing and instead produces directly a white liquor with high sulphide, e.g. according to WO91/08337 or EP617 747.

The invention claimed is:

1. Process for the recovery of chemicals and energy from spent liquor obtained in a chemical pulping process comprising:

gasifying the spent liquor under sub-stoichiometric conditions in a burner to produce partly at least one phase of solid and/or fused material and partly at least one phase of a flammable gaseous material;

removing the phases from the burner and then cooling the phases by direct contact with a cooling medium; and separating the phase of solid and/or fused material from the phase of flammable gaseous material such that the solid and/or fused material is dissolved and collected as a product liquid in a product liquid receiver, wherein the cooling medium consists of an essentially water-free cooling medium, which cooling medium is at least partly vaporized or cracked, whereby the vaporized/cracked cooling medium is drawn off together with the phase of flammable gaseous material, and the cooling medium after vaporizing/cracking increases the calorific value of the flammable gaseous material relative to the calorific value of the flammable gaseous material without addition of the essentially water-free cooling medium.

2. Process according to claim 1, wherein the cooling medium consists essentially of a liquified gas.

3. Process according to claim 1, wherein the cooling medium consists essentially of at least one selected from the group consisting of nitrogen, methane, propane and other hydrocarbons which are gaseous at NTP.

4. Process according to claim 1, wherein the cooling medium consists essentially of an organic liquid.

5. Process according to claim 1, wherein the cooling medium consists essentially of at least one selected from the group consisting of turpentine, tall oil, methanol and other alcohols which are liquids at NTP.

6. Process according to claim 1, wherein the cooling medium is recovered in the chemical pulping process or in a process for recovery of chemicals and energy from the spent liquor.

7. Process according to claim 1, wherein contact between the flammable gaseous material and the product liquid is avoided.

8. Process according to claim 1, wherein the cooling medium is sprayed into the mixture of solid and/or fused material and flammable gaseous material produced by the gasification.

9. Process according to claim 1, wherein the cooling medium is sprayed into the mixture of solid and/or fused material and flammable gaseous material produced by the gasification in connection with the separation of the two phases from each other.

10. Process according to claim 1, wherein the cooling with the water-free cooling medium is carried out as a first stage in connection with the separation of the material phases produced by gasification from each other, whereafter further cooling is carried out in a second stage with a second cooling medium consisting essentially of water.

11. Process according to claim 1, further comprising maintaining an essentially even temperature in the reaction vessel corresponding to the gasification temperature, wherein the separation in the separation section forms a part of the total reaction vessel.

12. Process according to claim 11, further comprising adding an inert gas immediately above a product liquid receiver surface to form a protecting blanket over the product liquid receiver to prevent carbonation of boiling and splashing green liquor from the product liquid receiver.

13. Process according to claim 12, further comprising cooling by means of the product liquid.

14. Process according to claim 12, further comprising cooling by means of the product liquid in the form of a liquid film on a wall arranged directly before the solid/fused material reaches the product liquid receiver.

* * * * *